US007740474B2

(12) United States Patent
Scheibel et al.

(10) Patent No.: US 7,740,474 B2
(45) Date of Patent: Jun. 22, 2010

(54) SUPPORT FOR STRUCTURAL COMPONENTS AND METHOD FOR PRODUCING THE SAME

(75) Inventors: Thorsten Scheibel, Bad Nauheim (DE); Roland Weiss, Huettenberg (DE); Martin Henrich, Wetzlar (DE); Marco Ebert, Wetter (DE); Stefan Schneweis, Graevenwiesbach (DE)

(73) Assignee: Schunk Kohlenstofftechnik GmbH, Heuchelheim (DE)

( * ) Notice: Subject to any disclaimer, the term of this patent is extended or adjusted under 35 U.S.C. 154(b) by 1225 days.

(21) Appl. No.: 10/560,287

(22) PCT Filed: Jun. 14, 2004

(86) PCT No.: PCT/EP2004/006381

§ 371 (c)(1),
(2), (4) Date: Dec. 12, 2005

(87) PCT Pub. No.: WO2004/111562

PCT Pub. Date: Dec. 23, 2004

(65) Prior Publication Data

US 2006/0199132 A1 Sep. 7, 2006

(30) Foreign Application Priority Data

Jun. 13, 2003 (DE) ..... 103 27 095
Oct. 6, 2003 (DE) ..... 103 46 765

(51) Int. Cl.
*F27D 5/00* (2006.01)

(52) U.S. Cl. ..... 432/261; 432/258

(58) Field of Classification Search ..... 432/120, 432/253, 258, 261, 41.18; 211/133.6, 41.18; 52/591.1; 148/527
See application file for complete search history.

(56) References Cited

U.S. PATENT DOCUMENTS

| | | | | | |
|---|---|---|---|---|---|
| 2,962,273 | A | * | 11/1960 | Moore | 432/261 |
| 3,410,546 | A | * | 11/1968 | Daringer et al. | 432/261 |
| 5,418,063 | A | * | 5/1995 | Booth | 428/408 |
| 6,050,437 | A | * | 4/2000 | Schutz | 220/4.12 |
| 6,461,156 | B2 | * | 10/2002 | Kumazawa et al. | 432/261 |
| 6,627,143 | B2 | * | 9/2003 | Hanzawa et al. | 264/657 |
| 2002/0162624 | A1 | | 11/2002 | Ebert et al. | |
| 2003/0192627 | A1 | * | 10/2003 | Lee et al. | 148/439 |

FOREIGN PATENT DOCUMENTS

| | | |
|---|---|---|
| DE | 7217903 | 5/1972 |
| DE | 8112537 | 9/1982 |
| DE | 4329792 | 3/1995 |
| DE | 19737212 | 3/1999 |
| DE | 19957906 | 6/2001 |
| JP | 2000304459 | 10/2000 |

* cited by examiner

*Primary Examiner*—Gregory A Wilson
(74) *Attorney, Agent, or Firm*—Dennison, Schultz & MacDonald

(57) ABSTRACT

A support for structural components that are subjected to a thermal treatment process. The support includes a frame having limbs and extending therefrom a grid of intersecting strands. In order to prevent the support from warping even when subjected to strong thermal loads or variations in temperature, the frame is produced from a temperature-resistant material and the strands are produced from carbon fibers or ceramic fibers that form the grid, extending from the limbs of the frame.

29 Claims, 3 Drawing Sheets

SUPPORT FOR STRUCTURAL COMPONENTS AND METHOD FOR PRODUCING THE SAME

BACKGROUND OF THE INVENTION

The invention relates to a carrier for structural parts to be subjected to a heat-treatment process, comprising at least one frame and a lattice extending therefrom comprising intersecting strands, the frame consisting of one or more limbs, which preferably form a polygon, and the frame comprising temperature-resistant material and the strands, extending from the limb or pieces of the frame to form the lattice, comprising carbon fibers or ceramic fibers.

To position or fix slim metallic or ceramic structural parts and components during heat-treatment processes, they are inserted into holding frames. Heat-treatment processes are, for example, sintering processes, hardening processes, finishing processes or soldering processes. Usual processing temperatures are between 700° C. and 2600° C., whereby one typically works at between 800° C. and 1600° C.

According to the prior art, frames having such lattices comprise metal. The lattices are thereby formed by strands in the form of rods having e.g. a diameter of 2 mm. However, such holding devices exhibit considerable disadvantages which can be seen, inter alia, in the following:

- distortions during thermal cycles,
- creep of the entire structure due to the effect of temperature,
- high dead weight,
- high heat capacity,
- short life due to embrittlement,
- high cost of adjustment to extend useful life,
- increased waste of the parts to be treated due to distortion of the holding device.

Due, particularly, to a reduced shape stability, problems are often caused in loading or unloading such holding devices by means of manipulators such as robots.

A fibrous composite part having a lattice-like structure which is used in high-temperature furnaces and system construction, in heat-treating technology or sintering technology as a grate, is known from DE-A 199 57 906. A fiber preform, which is produced especially according to the TFP (Tailored Fiber Placement) technology and then pyrolyzed, i.e. carbonized or graphitized, is used for the production.

A carrier for hardening material is described in DE-U 295 12 569. In this case, the carrier comprises carbon fiber-reinforced carbon material (CFC material) which can have a protective layer consisting of SiC, BN or TiN. The carrier comprises limbs that can be interconnected and have recesses that are aligned to one another through which the material to be hardened is passed.

SUMMARY OF THE INVENTION

A workpiece carrier for heat-treating workpieces is known from DE-A 197 37 212. The workpiece carrier may comprise a single-piece monolithically formed frame on which bent rods can be placed which are used to accommodate workpieces. According to a further embodiment, the carrier comprises a tubular construction about which the fiber bundles are wound, the fiber bundles extending at a spacing from one another.

A lattice-like carrier made of a ceramic material is known from JP-A 2000 304459 which has the form of a ceramic weave consisting of a frame and a lattice clamped and held thereby.

To produce a lattice according to EP-A 0 560 038, a form having a groove is provided into which the fibers are placed in order to then be hardened under pressure.

A carrier basket made of metal for accommodating structural parts which are being subjected to a heat-treatment process is known from U.S. Pat. No. 2,962,273.

The object of the present invention is to further develop a carrier of the aforementioned type in such a way that a distortion-free carrier is provided even under strong thermal loads or fluctuations in temperature in order to be able to subject structural parts to a heat treatment to the desired extent. According to a further aspect, it should be ensured that contact reactions between the components to be treated and the carrier or lattice are avoided. It should be possible to produce the carrier or lattice itself with structurally simple steps.

According to the invention, the object is essentially solved by a carrier of the aforementioned type in that the lattice is formed by a section of an endless fiber bundle in the form of single-layer or multilayer fiber strands or intertwined yarns of carbon-reinforced carbon material and/or ceramic material extending between limbs of the frame, the fiber bundle extending in a warp and woof-like web structure between the limbs of the frame. This produces a coarse woven structure whose mesh size can be individually designed in order to accommodate parts of any desired size.

If the frame consists of a single limb, then that limb has a curved shape in order to form e.g. an oval or a circle.

The carrier may comprise a single frame or of several frames extending at a right angle or parallel to one another which more or less combine to form a basket that is open on one side.

Independently hereof, whether single-layer or multilayer fiber bundles or intertwined fibers or yarns in the form of e.g. cords are used as fiber bundles which comprise carbon fibers or ceramic fibers, according to one embodiment the limbs of the frame have recesses on the longitudinal edges through which sections of the fiber bundle pass for extending the mesh. In particular, the recesses themselves form a comb-like geometry in the respective longitudinal edge.

Alternatively, there is the possibility that the limbs are provided with openings, such as borings, through which the fiber bundle passes. Depending on the position of the recesses or openings or their use, the mesh spacing, i.e. the mesh width of the mesh netting, can be varied in a simple manner.

Furthermore, it is foreseen that the fiber bundle, laid out in the web structure, is tensioned between the limbs, as a result of which it is ensured that the finished lattice cannot sag, i.e. forms a plane.

In particular, $Al_2O_3$, SiC, BN, C or $B_4C$ and/or combinations thereof are possible as material for the rovings or fibers.

Preferably, the frame comprises CFC, graphite or fibrous ceramic. The frame may have limbs produced by TFP (Tailored Fiber Placement) technology which can be joined together by plug-in connections. However, there is also the possibility of cutting a frame, e.g. by means of water jet, from a carbon fiber-reinforced carbon plate. Sections of such a plate can also be assembled to form a frame.

As long as the carrier has a more or less two-dimensional geometry, i.e. comprises a single frame with a lattice extending from its limbs, each limb should preferably form a plane which extends at a right angle to the plane formed by the lattice.

If the carrier has a basket geometry, i.e. e.g. a right parallelepiped that is open on one side, the carrier consists of base and side frames which are each a holder for a lattice.

In this case, it is preferably provided that the upper limb of each side frame is a flat element and/or the lower limb is an angular element and/or each side limb extending at a right angle thereto is a round element.

Furthermore, the flat element formed as a limb should, with its flat side, form a plane in which or almost in which the lattice held by the frame extends.

Adjoining flat limbs, which abut at a right angle or almost at a right angle, can be joined by a plug-in connection, which in turn extend within a round element. It is thereby provided that respective flat limbs of the frame extend in a flush manner at their outer longitudinal edges into respective front ends of a round limb.

In particular, $Al_2O_3$ and/or SiC and/or BN and/or C or combinations of one or more thereof are possible as fiber material.

Furthermore, a matrix can be provided for the woven structure which can consist of the following materials and/or combinations thereof: carbon, $B_4C$, $Al_2O_3$, SiC, $Si_3N_4$ or mullite. The matrix can in that case be separated from the gas phase by means of CVD and/or CVI or produced by pyrolysis of a precursor material such as phenol resin, furan resin or silicon precursors. A combination of such process steps is also possible.

To exclude contact reactions between the parts to be thermally treated and the carrier or lattice, a surface coating can, in addition, be applied to the fibrous ceramic support structure. The surface coating can consist of oxides, nitrides and/or carbides of the 3rd and 4th main group and/or 3rd to 6th subgroup of the periodic system and/or carbon.

The bars of the finished lattice typically have a diameter of between 1 mm and 10 mm, preferably between 2 mm and 4 mm.

The frame is preferably square or rectangular with a limb length of up to 2000 mm and/or a height of between 10 mm and 300 mm. Typical dimensions can be:

$450\times450\times50$ mm$^3$ or $900\times600\times40$ mm$^3$.

Other geometries of the frame, such as a circle or oval, are also possible. In this case, the frame can consist of e.g. a correspondingly curved limb or of e.g. two limbs combining to form such a geometry.

According to the invention, a fibrous ceramic supporting structure consisting of frame and lattice is provided with which metallic and/or ceramic parts or components thereof can be positioned or fixed in a heat-treatment process. In particular due to the lattice structure, the possibility is thereby given to vertically charge slim parts or components to the desired extent. In addition, the mesh width of the lattice should be correspondingly predetermined. For this purpose, the lattice extends at a distance from the respective longitudinal edge of each limb of the frame.

By the teachings according to the invention, a distortion-free carrier is produced independently of any thermal cycles undertaken, so that there is no readjustment cost. The carrier according to the invention exhibits a resistance to thermal shock, a low density and a lower heat capacity. Also, a creep tendency is not produced. Furthermore, the fact that an embrittlement does not take place should be noted as a special advantage. A long life is also ensured. In comparison to metallic carrier devices, a considerable reduction in waste is also observable.

A further advantage of the invention is the good flowability through the lattice structure. This results in great advantages when used in the hardening technology, e.g. during oil or gas quenching.

The previously described advantages relate not only to the carrier as such, but also to its components, in particular the lattice, which can be used as a separate part. Consequently, the invention also relates to a method for producing a lattice from intersecting strands of carbon fibers or ceramic fibers using a frame, from which the strands having the desired lattice structure are correspondingly extended, the matrix is then inserted into the fibers and subsequently the lattice is removed from the frame. The lattice can thereby be separated, e.g. severed, from the sections extending from the frame. The lattice can also be removed as a unit from the frame, if the strands extend from peripheral recesses.

The matrix can be separated from the gas phase and/or formed by pyrolysis of a precursor material. Furthermore, the surface can be coated prior to removal of the lattice from the frame. Oxides, nitrides and/or carbides of the 3rd and 4th main group and/or 3rd to 6th subgroup of the periodic system and/or carbon or combinations of some of these can be used as materials for this purpose.

$Al_2O_3$, SiC, BN, C or combinations or partial combinations thereof are possible as fiber material. Carbon, $B_4C$, $Al_2O_3$, SiC, $Si_3N_4$ or mullite or combinations or partial combinations thereof can be used as material for the matrix.

Such a lattice has a content of our own invention.

BRIEF DESCRIPTION OF THE DRAWINGS

Further details, advantages and features of the invention are given not only in the claims, the features found therein—alone and/or in combination—but also in the following description of a preferred embodiment illustrated in the drawings, in which:

DESCRIPTION OF THE PREFERRED EMBODIMENTS

Figure 1:
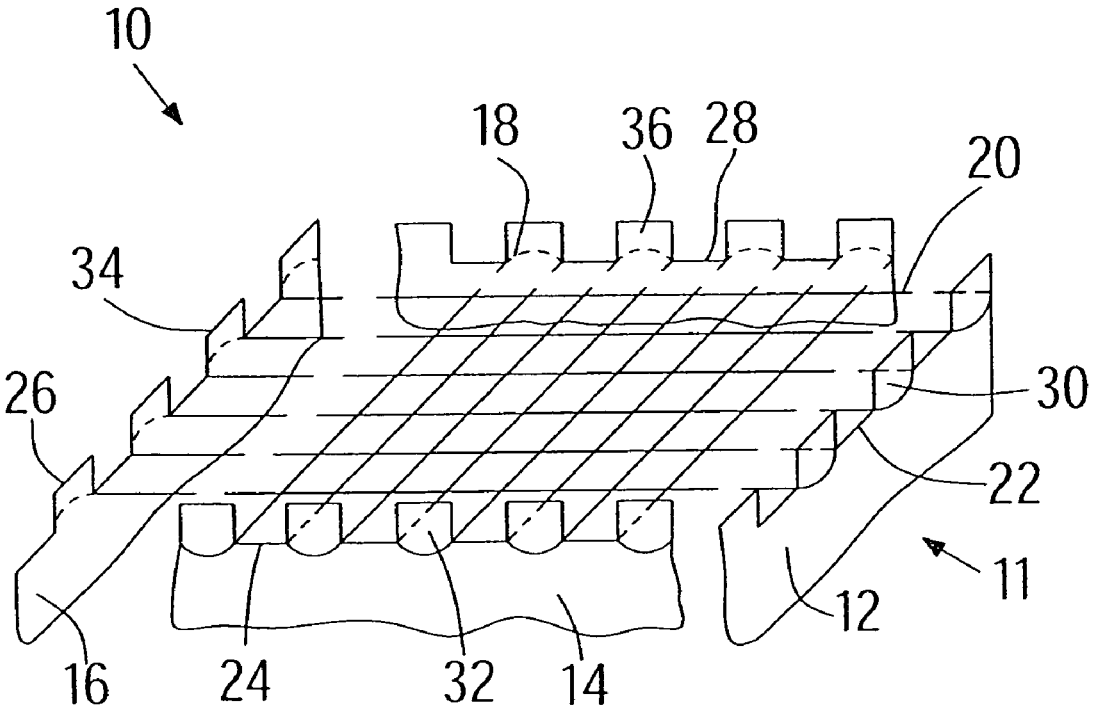
FIG. 1 shows a first embodiment of a carrier.
Figure 2:
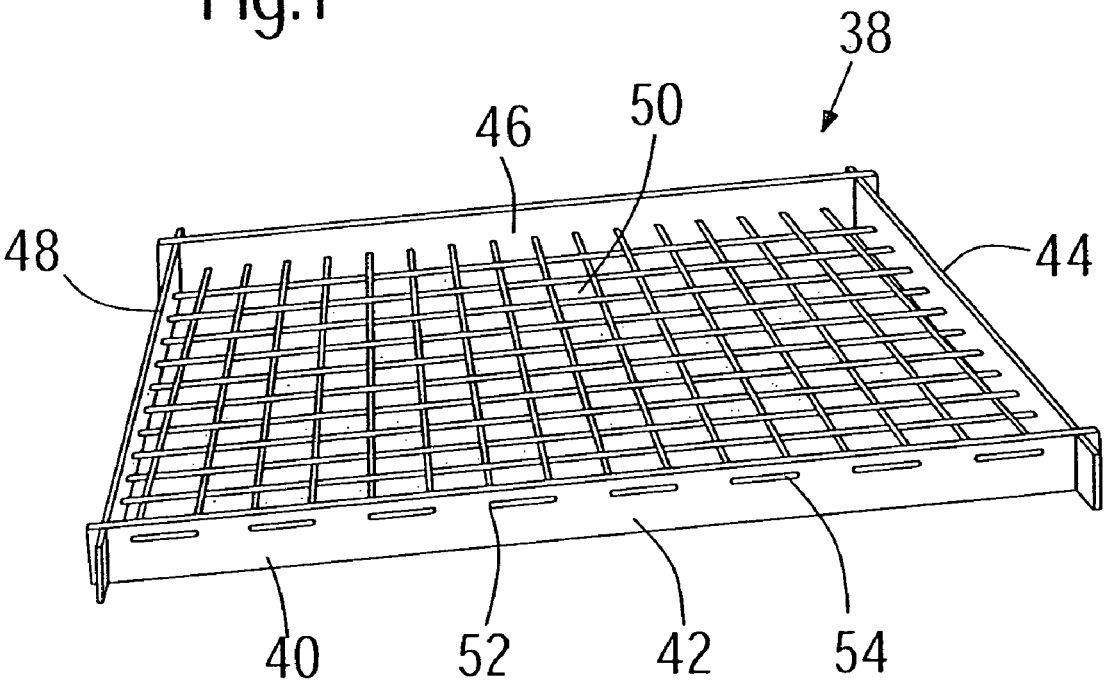
FIG. 2 shows a second embodiment of a carrier.
Figure 3:
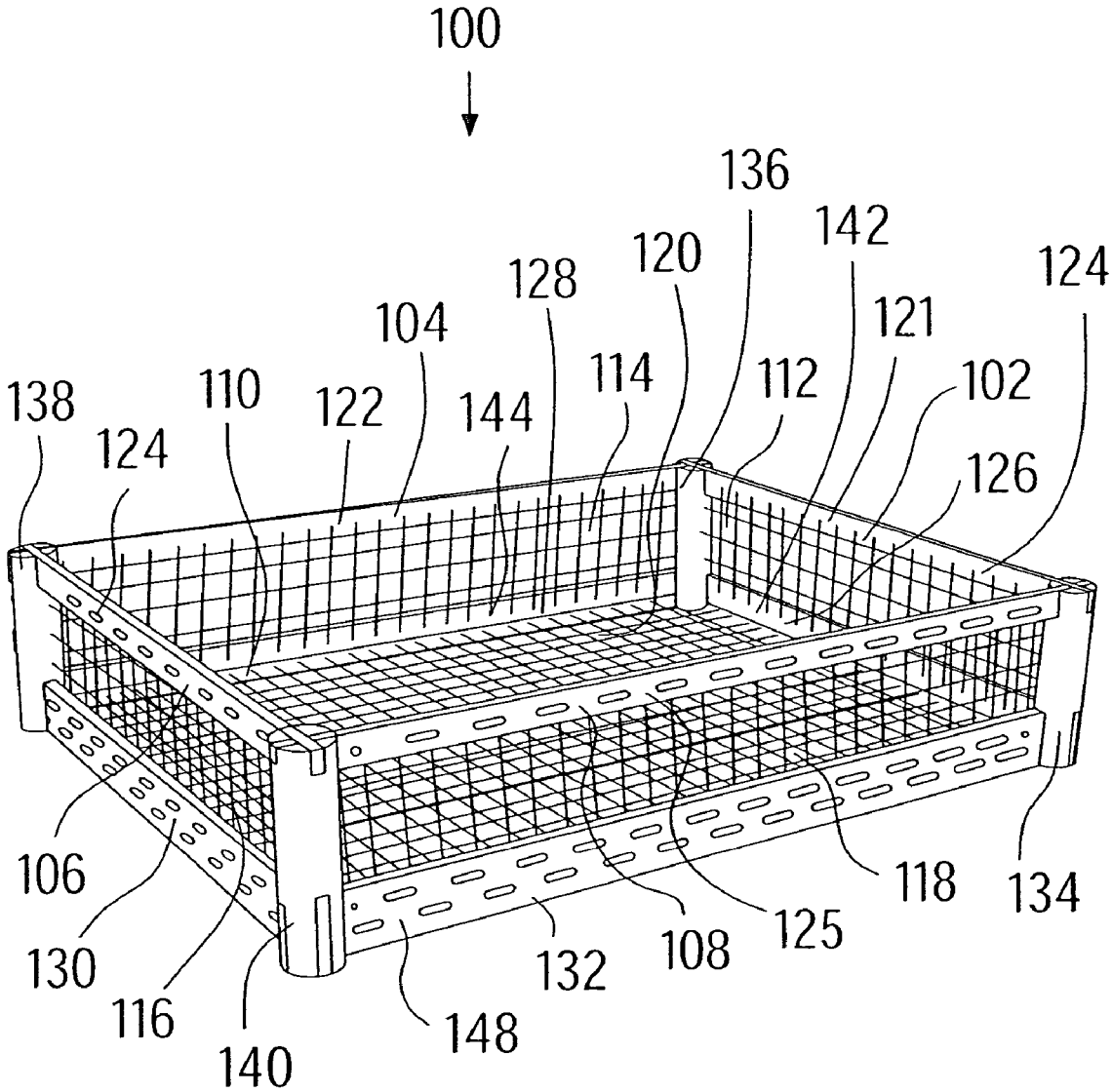
FIG. 3 shows a first view of a third embodiment of a carrier.
Figure 4:
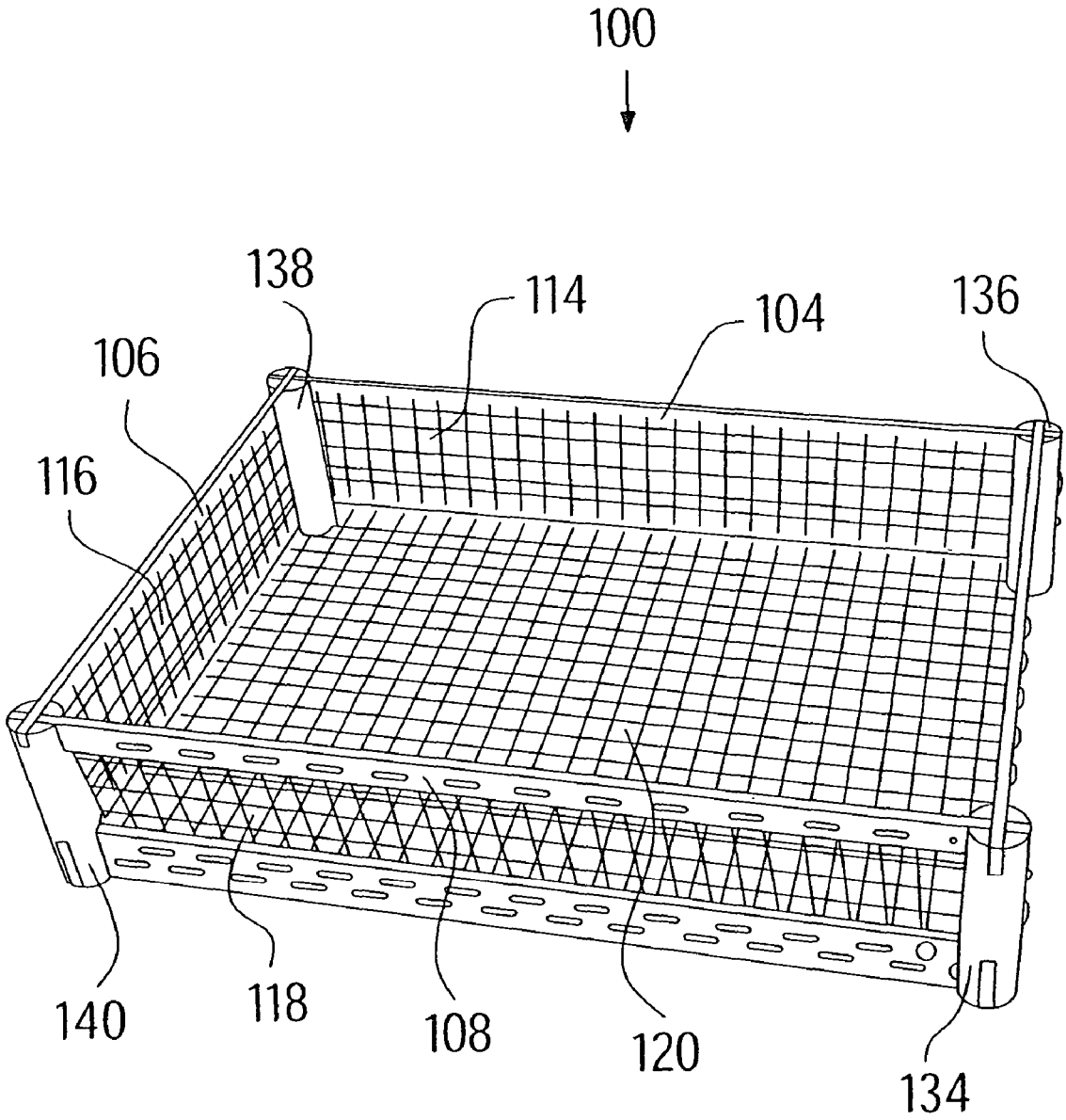
FIG. 4 shows a second view of the carrier according to FIG. 3.

FIGS. 1 and 2 show embodiments according to the invention of a more or less two-dimensional carrier, and FIGS. 3 and 4 of a three-dimensional carrier in the form of an open basket which has a parallelepiped geometry.

A carrier 10, which is to be used as a fibrous ceramic supporting structure, in particular, for positioning or fixing of e.g. metallic or ceramic parts or components during heat-treatment processes, is shown purely on principle in FIG. 1. The heat-treatment processes are e.g. sintering processes, hardening processes, finishing or soldering processes, which are carried out at temperatures of between 700° C. and 2600° C., typically between 800° C. and 1600° C.

To ensure that the carrier 10 is distortion-free, independently of any thermal cycles that might occur, it comprises carbon fiber-reinforced carbon or a fibrous ceramic and includes a frame 11 with limbs 12, 14, 16 18 as well as a lattice 20 extending or stretching therefrom. In the embodiment of FIG. 1, the lattice 20 is extended over projections 30, 32, 34, 36 forming a comb-like structure of upper longitudinal edges 22, 24, 26, 28 of the limbs 12, 14, 16, 18 and preferably consists of an endless carbon fiber strand. A ceramic fiber strand is also possible.

In particular, this is a single layer or multilayer fiber strand (roving).

The fiber strand forming the lattice 20 has, in particular, $Al_2O_3$, SiC, BN, C or combinations or partial combinations thereof as fiber-material.

The limbs 12, 14, 16, 18, which according to the embodiment shown in FIG. 2 can be joined together or otherwise connected, also consist of CFC or ceramic material. It would also be possible to construct the limbs as one piece, i.e. to form the frame integrally, by e.g. cutting it out of a carbon fiber-reinforced carbon plate by means of e.g. a water jet.

If the lattice 20 has a matrix, it can be separated from the gas phase (e.g. CVD/CVI) or be formed by pyrolysis of a precursor material such as e.g. phenolic resin, furan resin or Si precursors.

Carbon, $B_4C$, $Al_2O_3$, SiC, $Si_3N_4$ or mullite or combinations or partial combinations thereof are possible as materials for the matrix.

In addition, a surface coating can be provided which can comprise oxides, nitrides and/or carbides of the 3rd and 4th main group and/or 3rd to 6th subgroup of the periodic system and/or carbon or combinations or partial combinations thereof to prevent a contact reaction between the holding structure and the parts to be thermally treated. Holding structure refers to the frame 11 and/or the lattice 20.

A carrier 38 shown in FIG. 2 also comprises a frame 40 with limbs 42, 44, 46, 48 which are plugged together and between which a lattice 50 is extended. For this purpose, the limbs 42, 44, 46, 48 have bores 52, 54 through which single-layer or multilayer fiber strands or intertwined yarns pass which, in accordance with the aforementioned description, may consist of carbon fibers or ceramic fibers.

The carbon fibers, consisting especially of single-layer or multilayer fiber strands (rovings) or intertwined fiber strands (cords), for forming the lattice 20, 50 are laid to form a web structure, whereby the spacing between the strands can be preset to the desired degree in dependence on the projections 32, 34, 36, 30 extending from the limbs 12, 14, 16, 18 or 42, 44, 46, 48 and utilized or bores 52, 54. Also, the strands, i.e. in particular the fiber strands or yarns, forming the lattice 20, 50 are placed in a web structure (warp and woof).

A carrier 100 in the form of a basket can be seen in FIGS. 3 and 4 which, in turn, consists of side frames 102, 104, 106, 108 and base frame 110 and lattices 112, 114, 116, 118 and 120 stretching from them. Such a carrier 100 is intended, for example, for receiving metallic or ceramic parts or components which are to be subjected to a heat-treatment process.

The side frames 102, 104, 106, 108 consist of upper flat elements 121, 122, 124 and 125 and angular elements 126, 128, 130, 132 extending along the bottom which, in turn, form the base frame 110. Round elements 134, 136, 138, 140 form the side limbs of the side frames 102, 104, 106, 108.

Furthermore, it can be seen in FIGS. 3 and 4 that the longitudinal limbs 121, 122, 124, 125, 126, 128, 130, 132 are connected to one another by plug-in connections which extend into the round elements 134, 136, 138, 140 and extend flush with one another at the outside, as illustrated in the drawings.

The lattices 112, 114, 116, 118 are formed by single-layer or multilayer fiber strands, as can be seen in FIGS. 1 and 2. In this respect, reference is made to the embodiments relevant thereto.

The strands forming the lattice pass through bores, which are not shown in greater detail, in the limbs 121, 122, 124, 126 and the limb sections 142, 144, 146, 148 of the angular elements 126, 128, 130 and 132. The sections of the angular elements 126, 128, 130, 132 extending along the lattice 120 extend along the outer surface of the lattice 120 and thus serve as a support for the basket 100.

The lattices 112, 114, 116, 118, 120 or their fiber strands have, in particular, $Al_2O_3$, SiC, BN, C or combinations or partial combinations thereof as fiber material. If the respective lattice 112, 114, 116, 118, 120 has a matrix, it can be separated from the gas phase (for example CVD/CVI) or be formed by pyrolysis of a precursor material such as e.g. phenolic resin, furan resin or Si precursors.

Carbon, $B_4C$, $Al_2O_3$, SiC, $Si_3N_4$ or mullite or combinations or partial combinations thereof are possible as materials for the matrix.

Furthermore, a surface coating can be provided which can consist of oxides, nitrides and/or carbides of the third and fourth main group and/or the third to sixth subgroup of the periodic system and/or carbon or combinations or partial combinations thereof to prevent a contact reaction between the supporting structure and the parts to be thermally treated.

The supporting structure refers to the respective frame 112, 114, 116, 118, 120 and/or the lattice 102, 104, 106, 108, 110 stretching from it.

The limbs 121, 122, 124, 125, 126, 128, 130, 132, 134, 136, 138, 140 can consist of CFC or ceramic material.

If the carrier 10, 38 or the basket 100 can be used for positioning or fixing a part to be subjected to a heat-treatment process, then it is also possible to use the respective lattice 20, 50 itself. For this purpose, it can be separated from the frame 11, 40. Thus, in the embodiment of FIG. 1, it is only necessary that the lattice 20 be removed, i.e. pulled off, from the projections 30, 32, 34, 36. To use the lattice 50 according to FIG. 2, the sections passing through the bores 42, 54 must be removed.

Furthermore, it should be noted that the carbon fiber-reinforced carbon body, whether it be the lattice or the frame, can be converted into C—SiC or C/C—SiC by siliconization by means of an e.g. capillary infiltration process or liquid infiltration process with liquid silicon.

The invention claimed is:

1. A carrier for structural parts to be subjected to a heat-treatment process, comprising:

at least one frame comprising a plurality of limbs, and a lattice comprising intersecting strands extending from the frame, wherein the frame comprises a temperature-resistant material and the strands are formed of carbon fibers or ceramic fibers which form the lattice extending from the limbs, the lattice being formed by a section of an endless fiber bundle extending between limbs of the frame in the form of single-layer or multilayer fiber strands or intertwined yarns of a carbon-reinforced carbon material and/or ceramic material, the fiber bundle extending in a warp and woof-like woven structure between the limbs of the frame.

2. The carrier according to claim 1, wherein the limbs of the frame extend at a right angle to the plane formed by the lattice.

3. The carrier according to claim 2, wherein the carrier comprises a plurality of frames forming a three-dimensional body and has a basket geometry.

4. The carrier according to claim 1, wherein the limbs have recesses in longitudinal edges thereof, sections of the fiber bundle passing through said recesses to mount the lattice.

5. The carrier according to claim 4, wherein the recesses form a ridge-like geometry in the respective longitudinal edge of the limb of the frame.

6. The carrier according to claim 1, wherein the limbs of the frame have openings through which the fiber bundle passes.

7. The carrier according to claim 1, wherein the fiber bundle laid in the woven structure extends under prestress between the limbs.

8. The carrier according to claim 1, wherein the frame is integrally cut out of a carbon fiber-reinforced carbon plate.

9. The carrier according to claim 1, wherein the limbs forming the frame are joined together by means of plug connections.

10. The carrier according to claim 1, wherein the base of the frame or limbs thereof is a pyrolyzed fiber preform produced by means of TFP technology.

11. The carrier according to claim 1, wherein the frame comprises a section or sections separated by means of water jet cutting from a carbon fiber-reinforced carbon plate.

12. The carrier according to claim 1, wherein the fiber is formed of a material selected from the group consisting of $Al_2O_3$, SiC, BN, C and combinations thereof.

13. The carrier according to claim 1, wherein the lattice has a matrix which comprises a material selected from the group consisting of carbon, $B_4C$, $Al_2O_3$, SiC, $Si_3N_4$, mullite and combinations thereof.

14. The carrier according to claim 13, wherein the matrix is separated from the gas phase or formed by pyrolysis of a precursor material.

15. The carrier according to claim 14, wherein the precursor material is selected from the group consisting of phenolic resin, furan resin, a Si precursor and combinations thereof.

16. The carrier according to claim 1, wherein at least the lattice comprises a coating selected from the group consisting of oxides, nitrides and carbides of the third and fourth main group of the periodic table, oxides, nitrides and carbides of the third to sixth subgroup of the periodic table, carbon and combinations thereof.

17. The carrier according to claim 1, wherein the frame comprises carbon fiber-reinforced carbon, fiber ceramic or graphite.

18. The carrier according to claim 1, wherein the carrier has a parallelepiped geometry open on one side with bottom and side frames which are each holders for a lattice.

19. The carrier according to claim 18, wherein the frame is constructed such that at least one of the following applies:

an upper limb of each side frame is a flat element, a lower limb of each side frame is an angular element, and limbs at a right angle thereto are each a round element.

20. The carrier according to claim 19, wherein the flat element forms with a flat side thereof, a plane substantially in which the lattice fixed by the frame extends.

21. The carrier according to claim 19, wherein the respective flat element of the side frame passes over in a flush manner into the respective front end of a round element on the outer longitudinal peripheral side.

22. The carrier according to claim 19, wherein adjoining flat elements of substantially rectangular abutting frames are connected via a plug connection which, in turn, extends within one said round element.

23. A method for producing a structural part comprising intersecting strands of carbon fibers or ceramic fibers comprising obtaining a frame having one or more limbs, mounting on the frame an endless fiber bundle in the form of single-layer or multilayer fiber strands or intertwined yarns as strands to form a desired lattice structure, inserting a matrix is into the fibers and removing the lattice from the frame.

24. The method according to claim 23, wherein the lattice is separated from sections thereof extending from the frame.

25. The method according to claim 23, wherein the matrix is formed by at least one of separating from a gas phase and pyrolysis of at least one precursor material.

26. The method according to claim 23, wherein the lattice is coated on a surface thereof prior to or after removal of the lattice from the frame.

27. The method according to claim 26, wherein the lattice is surface-coated with a coating selected from the group consisting of oxides, nitrides and carbides of the third and fourth main group of the periodic table, oxides, nitrides and carbides of the third to sixth subgroup of the periodic table, carbon and combinations thereof.

28. The method according to claim 23, wherein the fiber strands are of a material selected from the group consisting of $Al_2O_3$, SiC, BN, C and combinations thereof.

29. The method according to claim 23, wherein the matrix is a material selected from the group consisting of carbon, $B_4C$, $Al_2O_3$, SiC, $Si_3N_4$, mullite and combinations thereof.

* * * * *